United States Patent [19]

Striegler et al.

[11] 3,960,213

[45] June 1, 1976

[54] PRODUCTION OF BITUMEN BY STEAM INJECTION

[75] Inventors: John Howard Striegler, Richardson; Eddie Paul Howell, Plano, both of Tex.

[73] Assignee: Atlantic Richfield Company, Los Angeles, Calif.

[22] Filed: June 6, 1975

[21] Appl. No.: 584,516

[52] U.S. Cl. ..... 166/272; 166/50

[51] Int. Cl.[2] ..... E21B 43/24

[58] Field of Search ..... 166/256, 259, 271, 272, 166/281, 285, 288, 303, 50, 52; 175/62

[56] References Cited

UNITED STATES PATENTS

| | | | |
|---|---|---|---|
| 1,816,260 | 7/1931 | Lee | 166/50 X |
| 2,874,777 | 2/1959 | Tadema | 166/256 |
| 2,906,337 | 9/1959 | Hennig | 166/272 X |
| 3,017,168 | 1/1962 | Carr | 166/256 X |
| 3,396,791 | 9/1966 | Meurs et al. | 166/272 |

*Primary Examiner*—Stephen J. Novosad
*Assistant Examiner*—George A. Suckfield
*Attorney, Agent, or Firm*—Ronnie D. Wilson

[57] ABSTRACT

A method of producing bitumen from a subterranean tar sand formation by the following multi-step method. First, an injection well is drilled to the formation and extended into the formation. Subsequent thereto, a perforated liner is inserted into the injection well extending the entire length thereof and having the perforations provided in the portion of the injection well in contact with the formation. Next, a plurality of production wells are drilled and completed into the formation positioned above and along the length of the injection well. Thereafter, a heated fluid is circulated through the injection well contacting the formation via the perforations and thereby reducing the viscosity of the bitumen contained therein rendering same mobile. Subsequently, the mobilized bitumen is recovered through the plurality of production wells.

6 Claims, 1 Drawing Figure

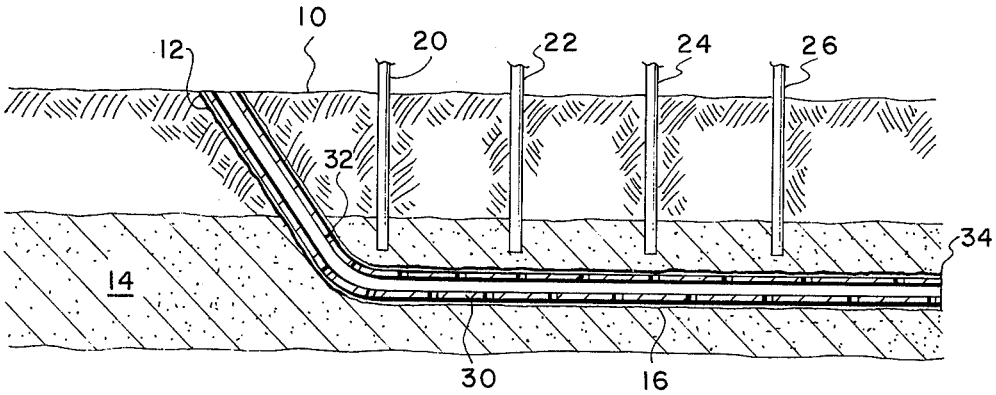
10
12
20
22
24
26
32
34
14
30
16

PRODUCTION OF BITUMEN BY STEAM INJECTION

The present invention relates to the recovery of bitumen from a subterranean tar sand formation by means of fluid drive. More particularly it is concerned with the recovery of bitumen by steam injection via a horizontal wellbore within the formation. The steam serves both as a driving agent to force the bitumen to the production well and as a viscosity lowering agent to mobilize the bitumen over a substantial portion of the formation.

Large deposits of petroleum exist in the world which cannot be produced efficiently by conventional methods because of their extremely high viscosity. Such deposits include the Athabasca tar sands in Canada, the Jobo region in Venezuela, and the Edna and Sisquoc regions in California. In the Athabasca region alone upwards of 1500 billion barrels of oil may be present. Only a small portion of these tar sands are recoverable by surface mining techniques. It is all too clear that if these energy values are to be recovered for this generation and those to come they must be recovered by in situ techniques. Various proposals have been set forth for recovering the petroleum of the type contemplated herein. Some have involved steam injection, in-place combustion, etc., but none have been very successful as yet. The well-known huff-and-puff process, for recovering petroleum in which steam is injected into a formation for a period of time after which the steam-saturated formation is allowed to soak for an additional interval prior to placing the well on production, has too much of a time lapse before production is obtained. One of the principle reasons for the lack of success of previously attempted steam injection techniques for recovering bitumen from a tar sand formation has been the difficulty in providing a permeable, competent communications path or zone connecting injection wells and production wells. The present invention provides a method for overcoming these previously encountered problems in recovering bitumen from tar sands.

It is therefore an object of our invention to provide a process by which heat can be applied to a large volume of a tar sand formation while a heated fluid is simultaneously used to force the bitumen of reduced viscosity from the tar sand formation to the production well. It is a particular object of our invention to provide a method of recovering bitumen from a subterranean tar sand formation via a wellbore extending into said formation. It is another object of our invention to recover bitumen from a subterranean tar sand formation by circulating a heated fluid through a wellbore having a perforated liner therein in fluid connection with a plurality of production wells positioned in said formation above and extending along said wellbore.

These and other objects will become apparent from the descriptive matter hereinafter, particularly when taken in conjunction with the FIGURE.

In accordance with the present invention, bitumen is recovered from a subterranean tar sand formation by the following multi-step method. First, an injection well is drilled to the formation and extended into the formation. Subsequent thereto, a perforated liner is inserted into the injection well extending the entire length thereof and having the perforations provided in the portion of the injection well in contact with the formation. Next, a plurality of production wells are drilled and completed into the formation positioned above and along the length of the injection well. Thereafter, a heated fluid is circulated through the injection well contacting the formation via the perforations thereby reducing the viscosity of the bitumen contained therein rendering same mobile. Subsequently, the mobilized bitumen is recovered through the plurality of production wells.

The FIGURE illustrates a vertical section of a subterranean tar sand formation penetrated by a horizontally deviated injection well and a plurality of production wells positioned above and along said injection well.

Referring to the FIGURE, the drawing illustrates the earth's surface 10 from which a wellbore having a first section 12 has been drilled to penetrate a subterranean tar sand formation 14 and having a horizontal section 16 extending a desired distance therethrough. The drawing further shows wellbores 20 through 26 drilled and completed to penetrate the subterranean tar sand 14 and positioned above and along said horizontal section 16 of wellbore 12. Continuous liner 30, having perforations located between points 32 and 34, is shown extending the entire length of the wellbore.

In carrying out an embodiment of the present invention and referring to the FIGURE, we have a single-ended wellbore having a first section 12 and horizontal section 16 penetrating the subterranean tar sand formation 14. Initially, first section 12 is drilled to penetrate the tar sand formation 14 and horizontal section 16 is provided for a suitable distance into said formation. The injection well is then provided with continuous liner 30 having perforations between points 32 and 34. Subsequently, vertical wellbores 20 through 26 are drilled and completed to penetrate the subterranean tar sand formation 14 and are positioned above and along, at suitable intervals, said horizontal section 16. After completion of drilling, circulation of a heated fluid such as steam or hot water is begun through the injection well, contacting the formation via the perforations. The circulation, initially, of heated fluid is done at such pressures to cause breakthrough into wellbores 20 through 26 for fluid communication therewith. As the heated fluid is circulated through said single-end wellbore and contact is made with the formation via the perforations, the temperature of the formation is raised and the bitumen contained therein is rendered mobile. The mobilized bitumen is recovered by the driving force of the circulating fluid. After initial breakthrough to the wellbores 20 through 26, said wellbores are plugged back to a shallower depth in the tar sand away from horizontal section 16 and circulation of heated fluid is continued. In the operation of our invention, care should be taken in correlating the fluid composition, the fluid flow rate and the rate at which the fluid temperature is raised above the reservoir temperature, so that an adequate rate of flow is maintained at pressures that remain below the fracturing pressure of said formation.

The diameter and length of the injection well is not critical and will be determined by conventional drilling criteria, the characteristics of the specific formation, and the economics of a given situation. The diameter of the production wells is not critical and will be determined by conventional drilling criteria, etc. The production wells, however, must at least extend from the surface into the tar sand formation. The optimum number of and distance between production wells is a balance of economic criteria. Perforation size will be a function of other factors such as flow rate, temperature and pressures employed in a given operation. However, the injection well, in order to most efficiently exploit the effects of gravity in recovering the bitumen should be extended into the formation at a position near the bottom thereof.

Having thus described the invention, it will be understood that such description has been given by way of illustration and not by way of limitation, reference for the latter purpose being had to the appended claims.

Therefore, we claim:

1. Method of recovering bitumen from a subterranean tar sand formation containing bitumen which comprises:

drilling an injection well to said formation and extending same into said formation;

inserting a perforated liner within said injection well which extends the entire length thereof, said perforations positioned in the portion of said injection well in contact with said formation;

drilling and completing a plurality of production wells into said formation positioned above and along the length of said injection well;

circulating a heated fluid through said injection well contacting said formation via said perforations and thereby reducing the viscosity of said bitumen contained therein;

recovering said bitumen of reduced viscosity via said production wells.

2. The method of claim 1 wherein said injection well is extended into said formation near the bottom of same.

3. The method of claim 1 wherein said heated fluid is steam.

4. The method of claim 1 wherein said heated fluid is hot water.

5. The method of claim 1 wherein said heated fluid is circulated at a pressure to provide fluid communication between said injection well and production wells.

6. The method of claim 5 wherein subsequent to achieving said fluid communication, circulation of said heated fluid is resumed.

* * * * *